US011045870B2

(12) United States Patent
Scott et al.

(10) Patent No.: US 11,045,870 B2
(45) Date of Patent: Jun. 29, 2021

(54) COMPOSITE MATERIALS INCLUDING NANOPARTICLES, EARTH-BORING TOOLS AND COMPONENTS INCLUDING SUCH COMPOSITE MATERIALS, POLYCRYSTALLINE MATERIALS INCLUDING NANOPARTICLES, AND RELATED METHODS

(71) Applicant: Baker Hughes Holdings LLC, Houston, TX (US)

(72) Inventors: Danny E. Scott, Montgomery, TX (US); Anthony A. DiGiovanni, Houston, TX (US); Jimmy W. Eason, The Woodlands, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 65 days.

(21) Appl. No.: 16/143,107

(22) Filed: Sep. 26, 2018

(65) Prior Publication Data

US 2019/0022745 A1 Jan. 24, 2019

Related U.S. Application Data

(62) Division of application No. 13/253,758, filed on Oct. 5, 2011, now Pat. No. 10,124,404.

(Continued)

(51) Int. Cl.

*C22C 32/00* (2006.01)
*B22D 19/14* (2006.01)

(Continued)

(52) U.S. Cl.

CPC ..... *B22D 19/14* (2013.01); *B22F 1/0003* (2013.01); *B22F 3/12* (2013.01); *B22F 7/08* (2013.01);

(Continued)

(58) Field of Classification Search

CPC ..... E21B 10/55; E21B 10/56; E21B 10/567; E21B 2010/561; E21B 17/1085

See application file for complete search history.

(56) References Cited

U.S. PATENT DOCUMENTS 3,175,427 A 3/1965 Bridwell et al.
4,268,582 A 5/1981 Hale et al.

(Continued)

FOREIGN PATENT DOCUMENTS

CN 101356340 A 1/2009
EP 1022764 A1 7/2000

(Continued)

OTHER PUBLICATIONS

U.S. Provisional Patent Application filed Apr. 14, 2010, and entitled Method of Preparing Polycrystalline Diamond From Derivatized Nanodiamond., U.S. Appl. No. 61/324,142.

(Continued)

*Primary Examiner* — David Carroll
(74) *Attorney, Agent, or Firm* — TraskBritt

(57) ABSTRACT

A composite material comprising a plurality of hard particles surrounded by a matrix material comprising a plurality of nanoparticles. Earth boring tools including the composite material and methods of forming the composite material are also disclosed. A polycrystalline material having a catalyst material including nanoparticles in interstitial spaces between inter-bonded crystals of the polycrystalline material and methods of forming the polycrystalline material are also disclosed.

19 Claims, 4 Drawing Sheets

Related U.S. Application Data

(60) Provisional application No. 61/391,344, filed on Oct. 8, 2010.

(51) Int. Cl.

| | |
|---|---|
| ***B22F 1/00*** | (2006.01) |
| ***B22F 3/12*** | (2006.01) |
| ***B22F 7/08*** | (2006.01) |
| ***C22C 19/07*** | (2006.01) |
| ***E21B 10/55*** | (2006.01) |

(52) U.S. Cl.

CPC ..... *C22C 19/07* (2013.01); *C22C 32/0047* (2013.01); *E21B 10/55* (2013.01)

(56) References Cited

U.S. PATENT DOCUMENTS

| | | | | |
|---|---|---|---|---|
| 4,696,352 | A | 9/1987 | Buljan et al. | |
| 5,011,514 | A | 4/1991 | Cho et al. | |
| 5,049,164 | A | 9/1991 | Horton et al. | |
| 5,511,603 | A | 4/1996 | Brown et al. | |
| 5,954,147 | A * | 9/1999 | Overstreet | E21B 10/567 175/374 |
| 6,241,036 | B1 | 6/2001 | Lovato et al. | |
| 6,742,611 | B1 | 6/2004 | Illerhaus et al. | |
| 7,776,256 | B2 | 8/2010 | Smith et al. | |
| 7,802,495 | B2 | 9/2010 | Oxford et al. | |
| 7,807,099 | B2 | 10/2010 | Choe et al. | |
| 7,814,997 | B2 | 10/2010 | Aliko et al. | |
| 8,579,052 | B2 | 11/2013 | DiGiovanni et al. | |
| 8,727,042 | B2 | 5/2014 | DiGiovanni | |
| 2007/0049484 | A1 | 3/2007 | Kear et al. | |
| 2007/0151769 | A1 | 7/2007 | Slutz et al. | |
| 2007/0187153 | A1 | 8/2007 | Bertagnolli | |
| 2008/0023231 | A1 | 1/2008 | Vail | |
| 2008/0127475 | A1* | 6/2008 | Griffo | E21B 4/00 29/33 K |
| 2008/0128176 | A1* | 6/2008 | Choe | B22D 23/00 175/426 |
| 2008/0149397 | A1 | 6/2008 | Overstreet | |
| 2008/0179104 | A1* | 7/2008 | Zhang | B22F 1/0025 175/374 |
| 2008/0209818 | A1 | 9/2008 | Belnap et al. | |
| 2009/0295048 | A1 | 12/2009 | Matsumoto et al. | |
| 2010/0276200 | A1 | 11/2010 | Schwefe et al. | |
| 2011/0000715 | A1 | 1/2011 | Lyons et al. | |
| 2011/0303465 | A1 | 12/2011 | Rupp et al. | |
| 2014/0013670 | A1 | 1/2014 | DiGiovanni et al. | |

FOREIGN PATENT DOCUMENTS

| | | | |
|---|---|---|---|
| EP | 1923476 | A2 | 5/2008 |
| JP | 2004-076043 | A | 3/2004 |
| JP | 2009-043672 | A | 2/2009 |
| WO | 2010/036569 | A2 | 4/2010 |

OTHER PUBLICATIONS

International Search Report for International Application No. PCT/US2011/054960, dated May 23, 2012, 4 pages.

International Preliminary Report on Patentability for International Application No. PCT/US2011/054960 dated Apr. 9, 2013, 5 pages.

European Search Report for European Application No. 11831538.1 dated Jun. 12, 2015. 10 pages.

European Examination Report for European Application No. 11831538.1, dated Oct. 11, 2016, 6 pages.

European Communication pursuant to Article 94(3) EPC for European Application No. 11831538.1, dated Jul. 28, 2017, 51 pages.

Chinese Office Action and Search Report for Chinese Application No. 201180055081.X dated Jul. 31, 2014, 14 pages.

* cited by examiner

COMPOSITE MATERIALS INCLUDING NANOPARTICLES, EARTH-BORING TOOLS AND COMPONENTS INCLUDING SUCH COMPOSITE MATERIALS, POLYCRYSTALLINE MATERIALS INCLUDING NANOPARTICLES, AND RELATED METHODS

CROSS-REFERENCE TO RELATED APPLICATIONS

This application is a divisional of U.S. patent application Ser. No. 13/253,758, filed Oct. 5, 2011, now U.S. Pat. No. 10,124,404, issued Nov. 13, 2018; which claims the benefit of U.S. Provisional Patent Application 61/391,344, filed Oct. 8, 2010, and entitled "COMPOSITE MATERIALS INCLUDING NANOPARTICLES, EARTH-BORING TOOLS AND COMPONENTS INCLUDING SUCH COMPOSITE MATERIALS, POLYCRYSTALLINE MATERIALS INCLUDING NANOPARTICLES, AND RELATED METHODS;" the disclosures of each of which are hereby incorporated by reference herein in their entirety.

TECHNICAL FIELD

Embodiments of the present disclosure generally relate to earth-boring tools and to methods of manufacturing such earth-boring tools. More particularly, the present disclosure generally relates to composite materials and polycrystalline materials employing nanoparticles and which may be used for forming at least a portion of an earth-boring tool, and to methods of manufacturing such earth-boring tools.

BACKGROUND

Rotary drill bits are commonly used for drilling boreholes, or well bores, in earth formations. Rotary drill bits include two primary configurations. One configuration is the roller cone bit, which conventionally includes three roller cones mounted on support legs that extend from a bit body. Each roller cone is configured to spin or rotate on a support leg. Teeth are provided on the outer surfaces of each roller cone for cutting rock and other earth formations. The teeth often are coated with an abrasive, hard ("hardfacing") material. Such materials often include tungsten carbide particles dispersed throughout a metal alloy matrix material. Alternatively, receptacles are provided on the outer surfaces of each roller cone into which hard metal inserts are secured to form the cutting elements. In some instances, these inserts comprise a superabrasive material formed on and bonded to a metallic substrate. The roller cone drill bit may be placed in a borehole such that the roller cones abut against the earth's formation to be drilled. As the drill bit is rotated under applied weight-on-bit, the roller cones roll across the surface of the formation, and the teeth crush the underlying formation.

A second, primary configuration of a rotary drill bit is the fixed-cutter bit (often referred to as a "drag" bit), which conventionally includes a plurality of cutting elements secured to a face region of a bit body. Generally, the cutting elements of a fixed-cutter type drill bit have either a disk shape or a substantially cylindrical shape. A hard, superabrasive material, such as mutually bonded particles of polycrystalline diamond, may be provided on a substantially circular end surface of each cutting element to provide a cutting surface. Such cutting elements are often referred to as "polycrystalline diamond compact" (PDC) cutters. The cutting elements may be fabricated separately from the bit body and are secured within pockets formed in the outer surface of the bit body. A bonding material such as an adhesive or a braze alloy may be used to secure the cutting elements to the bit body. The fixed-cutter drill bit may be placed in a borehole such that the cutting elements abut against the earth's formation to be drilled. As the drill bit is rotated, the cutting elements scrape across and shear away the surface of the underlying formation.

The bit body of a rotary drill bit of either primary configuration may be secured, as is conventional, to a hardened steel shank having an American Petroleum Institute (API) threaded pin for attaching the drill bit to a drill string. The drill string includes tubular pipe and equipment segments coupled end-to-end between the drill bit and other drilling equipment at the surface. Equipment such as a rotary table or top drive may be used for rotating the drill string and the drill bit within the borehole. Alternatively, the shank of the drill bit may be coupled directly to the drive shaft of a down-hole motor, which then may be used to rotate the drill bit.

The bit body of a rotary drill bit may be formed from steel. Alternatively, the bit body may be formed from a particle-matrix composite material. Such particle-matrix composite materials conventionally include hard tungsten carbide particles randomly dispersed throughout a copper or copper-based alloy matrix material (often referred to as a "binder" material). Such bit bodies conventionally are formed by embedding a steel blank in tungsten carbide particulate material within a mold, and infiltrating the particulate tungsten carbide material with molten copper or copper-based alloy material. Drill bits that have bit bodies formed from such particle-matrix composite materials may exhibit increased erosion and wear resistance, but lower strength and toughness, relative to drill bits having steel bit bodies.

As subterranean drilling conditions and requirements become ever more rigorous, there arises a need in the art for novel particle-matrix composite materials for use in bit bodies of rotary drill bits that exhibit enhanced physical properties and that may be used to improve the performance of earth-boring rotary drill bits.

SUMMARY

One embodiment of the disclosure comprises a composite material comprising a matrix material, hard particles dispersed within the matrix material, and nanoparticles dispersed within the matrix material between and comprising a different material than a material of the hard particles.

Another embodiment comprises a cutting element for use on an earth-boring drill bit, comprising a member including a segment-retaining portion and a drill bit attachment portion attachable to a drill bit, and a segment secured to the segment-retaining portion of the member and comprising a plurality of hard particles and a plurality of nanoparticles dispersed within a matrix material.

Yet another embodiment comprises an earth-boring tool for drilling subterranean formations, the earth-boring tool comprising a bit body including a crown region comprising a particle-matrix composite material, the particle-matrix composite material comprising hard particles and nanoparticles dispersed within a matrix material, wherein the nanoparticles comprise a different material from the hard particles, and at least one cutting structure disposed on the bit body.

A further embodiment comprises a polycrystalline compact cutting element for use in an earth-boring tool, the polycrystalline compact comprising a region of polycrystalline material comprising nanoparticles in interstitial spaces between inter-bonded crystals in the region of the polycrystalline material, wherein the nanoparticles comprise a catalyst material.

A still further embodiment comprises a method of forming a composite material, the method comprising melting a matrix material to form a molten matrix material, adding nanoparticles to the molten matrix material to form a molten matrix material mixture, infiltrating hard particles comprising a different material than the nanoparticles with the molten matrix material mixture, and cooling the molten matrix material mixture to form a composite material comprising the matrix material, the hard particles and nanoparticles in the matrix material interspersed between hard particles.

One other embodiment comprises a method of forming an earth-boring tool, the method comprising providing hard particles and nanoparticles within a cavity of a mold, wherein the nanoparticles comprise a different material from the hard particles, the cavity having a shape corresponding to at least a portion of a bit body of an earth-boring tool for drilling subterranean formations, infiltrating the hard particles and the nanoparticles with a molten matrix material, and cooling the molten matrix material to form a solid matrix material surrounding the hard particles and the nanoparticles.

Another embodiment comprises a method of forming a component of an earth-boring tool, the method comprising mixing hard particles, nanoparticles comprising a material different from a material of the hard particles, and particles comprising a metal matrix material to form a powder mixture, pressing the powder mixture to form a green body, and sintering the green body to a desired final density.

A further embodiment comprises a method of forming a polycrystalline compact cutting element for an earth-boring tool, the method comprising sintering a mass of hard particles interspersed with nanoparticles comprising a catalyst material under high-pressure, high-temperature conditions.

BRIEF DESCRIPTION OF THE SEVERAL VIEWS OF THE DRAWINGS

While the specification concludes with claims particularly pointing out and distinctly claiming what are regarded as embodiments of the present disclosure, advantages of the disclosure may be more readily ascertained from the description of some embodiments provided below, when read in conjunction with the accompanying drawings, in which:

DETAILED DESCRIPTION

The illustrations presented herein are not meant to be actual views of any particular material, apparatus, or method, but are merely idealized representations which are employed to describe embodiments of the present disclosure. Additionally, elements common between figures may retain the same numerical designation.

Figure 1:
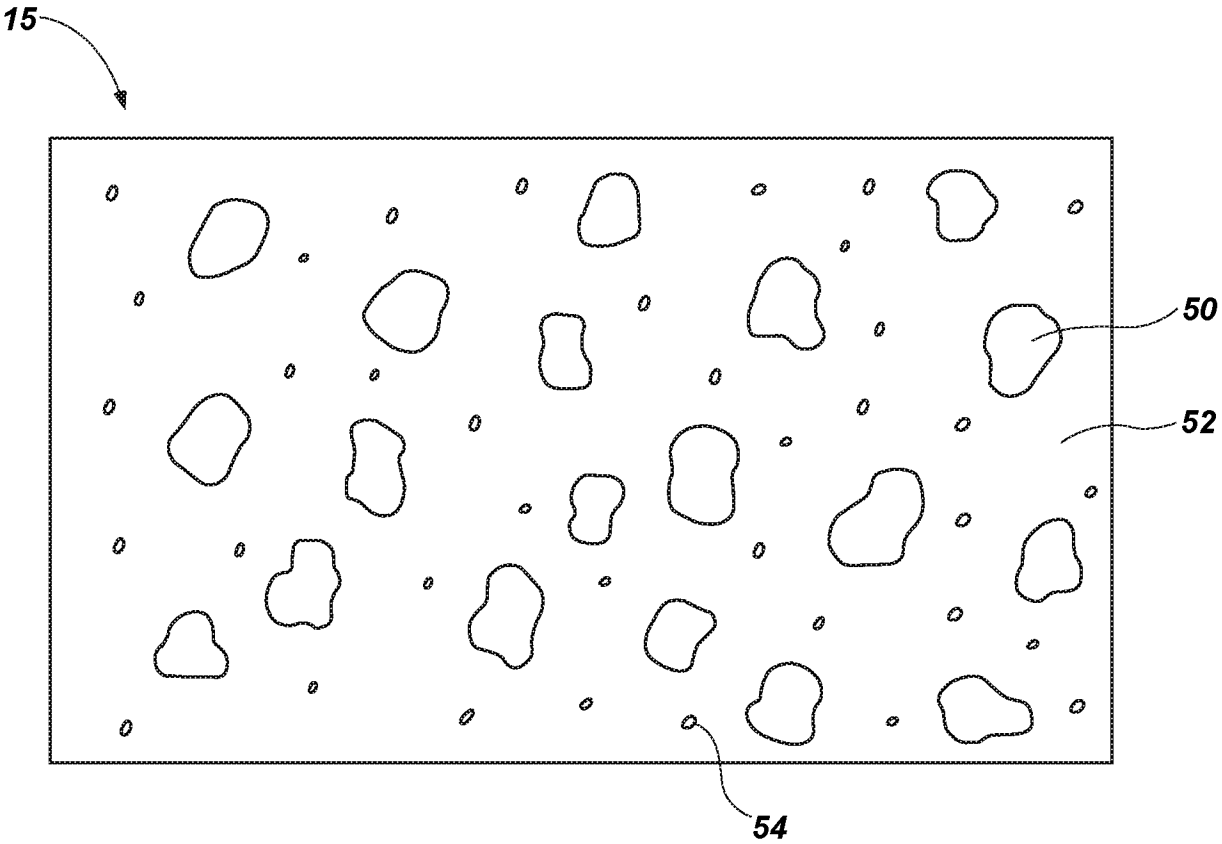
FIG. 1 is an illustration representing one example of how a microstructure of a particle-matrix composite material of the present disclosure may appear under magnification.

FIG. 1 is an illustration providing one example of how the microstructure of a particle-matrix composite material 15 of the present disclosure may appear in under magnification acquired using, for example, an optical microscope, a scanning electron microscope (SEM), or other instrument capable of acquiring or generating a magnified image of the particle-matrix composite material 15. As shown in FIG. 1, the particle-matrix composite material 15 may include a plurality of hard particles 50 dispersed within a matrix material 52. The matrix material 52 comprises a plurality of nanoparticles 54 dispersed therein. In other words, the particle-matrix composite material 15 may include a plurality of discontinuous phase regions dispersed throughout a continuous metal or metal alloy phase, the metal or metal alloy phase including a plurality of nanoparticles 54. In some embodiments, the hard particles 50 may comprise a material selected from diamond, boron carbide, boron nitride, silicon nitride, aluminum nitride, and carbides or borides of the group consisting of W, Ti, Mo, Nb, V, Hf, Zr, Si, Ta, and Cr. The matrix material 52 may be selected from the group consisting of copper-based alloys, iron-based alloys, nickel-based alloys, cobalt-based alloys, titanium-based alloys, aluminum-based alloys, iron- and nickel-based alloys, iron- and cobalt-based alloys, and nickel- and cobalt-based alloys. As used herein, the term "[metal]-based alloy" (where [metal] is any metal) means commercially pure [metal] in addition to metal alloys wherein the weight percentage of [metal] in the alloy is greater than or equal to the weight percentage of all other components of the alloy individually. In some embodiments, the matrix material 52 comprises cobalt. In some embodiments, each of the hard particles 50, the matrix material 52, and the nanoparticles 54 comprise a different material.

The nanoparticles 54 may have an average particle diameter of about five hundred nanometers (500 nm) or less. For example, in some embodiments, the nanoparticles 54 may have a diameter less than about one hundred nanometers (100 nm). By way of example and not limitation, the matrix material 52 may comprise between about one percent (1%) to about twenty-five percent (25%) by weight nanoparticles 54.

As known in the art, the average particle size of the nanoparticles 54 within a microstructure may be determined by measuring grains of the microstructure under magnification. For example, a scanning electron microscope (SEM), a field emission scanning electron microscope (FESEM), or a transmission electron microscope (TEM) may be used to view or image a surface of a bit body 12 (FIG. 2) (e.g., a polished and etched surface of the bit body 12) or a suitably prepared section of the surface in the case of the TEM as known in the art. Commercially available vision systems or image analysis software are often used with such microscopy tools, and these vision systems are capable of measuring the average particle size of nanoparticles within a microstructure.

The material of the nanoparticles 54 may be selected to improve a desired characteristic of the matrix material 52. For example, the material of the nanoparticles 54 may be selected to improve at least one of the strength, yield point, ductility, impact strength, and abrasivity of the matrix material 52. As a non-limiting example, in some embodiments, the nanoparticles 54 may comprise a harder material (e.g., as determined by a Vickers hardness test) than the matrix material 52. By selecting the nanoparticles 54 to comprise a harder material than the matrix material 52, at least one of the hardness, abrasion resistance, and strength of bit body 12 (FIG. 2) may be improved. Similarly, the material of the nanoparticles 54 may be selected to have a higher strength, yield, ductility, impact strength, or abrasivity than the matrix material 52 to improve the those characteristics of the matrix material 52.

The nanoparticles 54 may comprise, for example, at least one of borides, nitrides, oxides, carbides, and refractory metals. In some embodiments, the nanoparticles 54 may comprise, for example, at least one of diamond, polycrystalline cubic boron nitride, silicon nitride, silicon carbide, titanium carbide, tungsten carbide, tantalum carbide, or another hard material. The nanoparticles 54 may not be hard particles in some embodiments of the disclosure. For example, the nanoparticles 54 may comprise one or more of carbides, ceramics, oxides, intermetallics, clays, minerals, glasses, elemental constituents, various forms of carbon, such as carbon nanotubes, fullerenes, adamantanes, amorphous carbon, etc. Furthermore, in some embodiments, the nanoparticles 54 may comprise a carbon allotrope and may have an average aspect ratio of about one hundred to one (100:1) or less. In further embodiments, the nanoparticles 54 may comprise vanadium carbide or titanium diboride.

In further embodiments, the nanoparticles 54 may comprise vanadium carbide or titanium diboride. In some embodiments, the nanoparticles 54 may not be distinguishable from the matrix material 52 within the particle-matrix composite material, while in other embodiments, the nanoparticles 54 may maintain all or some of their original structure and integrity and be distinguishable within the matrix material 52. For example, the nanoparticles 54 may partially or fully melt and/or dissolve within the matrix material 52 during formation of the particle-matrix composite material 15. Such melting may result in alloying of the material of the nanoparticles 54 with the matrix material 52. In some embodiments, the material of the nanoparticles 54 may become evenly dispersed throughout the matrix material 52. In other embodiments, the matrix material 52 may be interspersed with areas of greater concentration of the material of the nanoparticles 54 where the nanoparticles 54 melted or dissolved. In some embodiments, the nanoparticles 54 may comprise a material that reacts with the matrix material 52. The entire thickness of each nanoparticle of the plurality of nanoparticles 54 may react with the matrix material 52 or, alternatively, only an outer portion of each of the plurality of nanoparticles 54 may react with the matrix material 52 and an inner portion of each of the plurality of nanoparticles 54 may remain unreacted. In further embodiments, the plurality of nanoparticles 54 may help to create a spinodal decomposition of the matrix material 52.

In some embodiments of the present disclosure, the nanoparticles 54 may be coated, metallized, functionalized, or derivatized to include functional groups. Derivatizing the nanoparticles 54 may increase the stability of the nanoparticles 54 in liquid-based processing steps, which may help to hinder or prevent agglomeration of the nanoparticles during formation of the particle-matrix composite material 15. Such methods of forming derivatized nanoparticles are described in U.S. Provisional Patent Application No. 61/324,142, filed Apr. 14, 2010, and entitled "Method of Preparing Polycrystalline Diamond From Derivatized Nanodiamond," the disclosure of which provisional patent application is incorporated herein in its entirety by this reference.

As previously discussed, the nanoparticles 54 may comprise a coating. In some embodiments, the coating may be inert or resistant to dissolving within the matrix material 52 to help maintain the integrity of the nanoparticle 54. In some embodiments, the coating on the nanoparticles 54 may comprise a material configured to enhance the wettability of the nanoparticles 54 to the matrix material 52 and/or to prevent any detrimental chemical reaction from occurring between the nanoparticles 54 and the surrounding matrix material 52. By way of example and not limitation, each nanoparticle of the nanoparticles 54 may comprise a coating of at least one of tin oxide ($SnO_2$), tungsten, nickel, and titanium. Furthermore, in some embodiments, trace amounts of at least one of silver, gold, and indium may, optionally, be included in the matrix material 52 to enhance the wettability of the matrix material relative to the nanoparticles 54.

Figure 2:
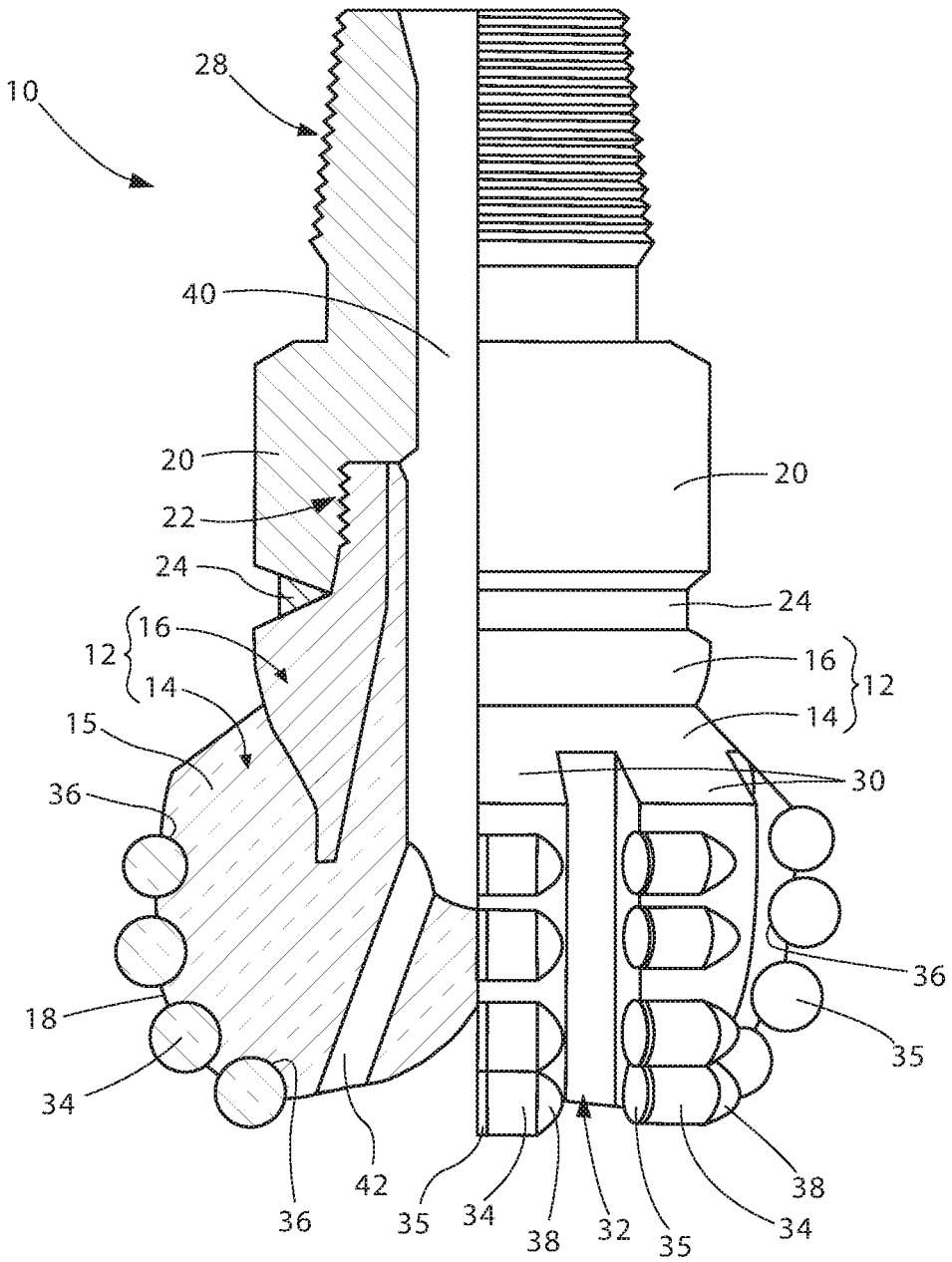
FIG. 2 is a partial cross-sectional side view of an earth-boring rotary drill bit including the particle-matrix composite material of the present disclosure.

The particle-matrix composite material 15 including the nanoparticles 54 of the present disclosure may be used to form at least one component of an earth-boring tool. For example, an embodiment of an earth-boring rotary drill bit 10 of the present disclosure is shown in FIG. 2. The drill bit 10 includes a bit body 12 comprising the particle-matrix composite material 15 that includes the plurality of hard particles 50 dispersed throughout the matrix material 52 comprising the plurality of nanoparticles 54 (FIG. 1) therein. By way of example and not limitation, the bit body 12 may include a crown region 14 and a metal blank 16. The crown region 14 may be predominantly comprised of the particle-matrix composite material 15, as shown in FIG. 2. The metal blank 16 may comprise a metal or metal alloy, and may be configured for securing the crown region 14 of the bit body 12 to a metal shank 20 that is configured for securing the drill bit 10 to a drill string (not shown). The metal blank 16 may be secured to the crown region 14 during fabrication of the crown region 14, as discussed in further detail below. In additional embodiments, however, the drill bit 10 may not include a metal blank 16.

Referring again to FIG. 2, the bit body 12 may be secured to the metal shank 20 by way of, for example, a threaded connection 22 and a weld 24 that extends around the drill bit 10 on an exterior surface thereof along an interface between the bit body 12 and the metal shank 20. The metal shank 20 may be formed from steel, and may include a threaded pin 28 conforming to American Petroleum Institute (API) standards for attaching the drill bit 10 to a drill string (not shown).

As shown in FIG. 2, the bit body 12 may include wings or blades 30 that are separated from one another by junk slots 32. Internal fluid passageways 42 may extend between the face 18 of the bit body 12 and a longitudinal bore 40, which extends through the steel shank 20 and at least partially through the bit body 12. In some embodiments, nozzle inserts (not shown) may be provided at the face 18 of the bit body 12 within the internal fluid passageways 42.

The drill bit 10 may include a plurality of cutting structures on the face 18 thereof. By way of example and not limitation, a plurality of polycrystalline diamond compact (PDC) cutters 34 may be provided on each of the blades 30, as shown in FIG. 2. Each of the PDC cutters 34 may comprise a diamond table 35 as described in greater detail below. The PDC cutters 34 may be provided along the blades 30 within cutting element pockets 36 formed in the face 18 of the bit body 12, and may be supported from behind by buttresses 38, which may be integrally formed with the crown region 14 of the bit body 12.

The metal blank 16 shown in FIG. 2 may be generally cylindrically tubular. In additional embodiments, the metal blank 16 may have a fairly complex configuration and may include external protrusions corresponding to blades 30 or other features extending on the face 18 of the bit body 12.

The rotary drill bit 10 shown in FIG. 2 may be fabricated by separately forming the bit body 12 and the shank 20, and then attaching the shank 20 and the bit body 12 together. The bit body 12 may be formed by a variety of techniques, some of which are described in further detail below.

In some embodiments, the bit body 12 may be formed using so-called "suspension" or "dispersion" casting techniques. For example, a mold (not shown) may be provided that includes a mold cavity having a size and shape corresponding to the size and shape of the bit body 12. The mold may be formed from, for example, graphite or any other high-temperature refractory material, such as a ceramic. The mold cavity of the mold may be machined using a five-axis machine tool. Fine features may be added to the cavity of the mold using hand-held tools. Additional clay work also may be required to obtain the desired configuration of some features of the bit body 12. Where necessary, preform elements or displacements (which may comprise ceramic components, graphite components, or resin-coated sand compact components) may be positioned within the mold cavity and used to define the internal fluid passageways 42, cutting element pockets 36, junk slots 32, and other external topographic features of the bit body 12.

After forming the mold, a suspension may be prepared that includes a plurality of hard particles 50 and the nanoparticles 54 suspended within molten matrix material 52 (FIG. 1). Matrix material 52 having a composition as described herein may be heated to a temperature sufficient to cause the mixture to melt, forming a molten matrix material 52 of desired composition. After forming the molten matrix material 52 of desired composition, hard particles 50 and nanoparticles 54 may be suspended and dispersed throughout the molten matrix material 52 to form the suspension. As previously mentioned, in some embodiments, the nanoparticles 54 may be coated with a material configured to enhance the wettability of the nanoparticles to the molten matrix material 52, to prevent any detrimental chemical reaction from occurring between the nanoparticles 54 and the molten matrix material 52, or both.

Optionally, a metal blank 16 (FIG. 2) may be at least partially positioned within the mold such that the suspension may be cast around the metal blank 16 within the mold.

The suspension comprising the hard particles 50, the nanoparticles 54, and molten matrix material 52 may be poured into the mold cavity of the mold. As the molten matrix material 52 (e.g., the metal alloy materials) may be susceptible to oxidation, the infiltration process may be carried out under vacuum. In additional embodiments, the molten matrix material 52 may be substantially flooded with an inert gas or a reductant gas to prevent oxidation of the molten matrix material 52. In some embodiments, pressure may be applied to the suspension during casting to facilitate the casting process and to substantially prevent formation of voids within the bit body 12.

After casting the suspension within the mold, the molten matrix material 52 may be allowed to cool and solidify, forming the solid matrix material 52 of the particle-matrix composite material 15 including the nanoparticles 54 around the hard particles 50.

In some embodiments, the bit body 12 may be formed using so-called "infiltration" casting techniques. For example, a mold (not shown) may be provided that includes a mold cavity having a size and shape corresponding to the size and shape of the bit body 12. The mold may be formed from, for example, graphite or any other high-temperature refractory material, such as a ceramic. The mold cavity of the mold may be machined using a five-axis machine tool. Fine features may be added to the cavity of the mold using hand-held tools. Additional clay work also may be required to obtain the desired configuration of some features of the bit body 12. Where necessary, preform elements or displacements (which may comprise ceramic components, graphite components, or resin-coated sand compact components) may be positioned within the mold cavity and used to define the internal fluid passageways 42, cutting element pockets 36, junk slots 32, and other external topographic features of the bit body 12.

After forming the mold, a plurality of hard particles 50 (FIG. 1) may be provided within the mold cavity to form a body having a shape that corresponds to at least the crown region 14 of the bit body 12. In some embodiments, the nanoparticles 54 may be provided within the mold cavity with the hard particles 50. The nanoparticles 54 may be arranged within the mold such that the concentration of nanoparticles 54 is increased at areas of greater expected wear. Optionally, a metal blank 16 (FIG. 2) may be at least partially embedded within the hard particles 50 such that at least one surface of the metal blank 16 is exposed to allow subsequent machining of the surface of the metal blank 16 (if necessary) and subsequent attachment to the shank 20.

Molten matrix material 52 having a composition as previously described herein then may be prepared by heating the matrix material 52 to a temperature sufficient to cause the matrix material 52 to melt, thereby forming a molten matrix material 52. In some embodiments, the nanoparticles 54 may be added to the molten matrix material 52, in addition to or in lieu of nanoparticles 54 previously placed within the mold cavity. The molten matrix material 52 including, optionally, the nanoparticles 54 then may be allowed or caused to infiltrate the spaces between the hard particles 50 and optionally, the nanoparticles 54, within the mold cavity. Optionally, pressure may be applied to the molten matrix material 52 to facilitate the infiltration process as necessary or desired. As the molten materials may be susceptible to oxidation, the infiltration process may be carried out under vacuum. In additional embodiments, the molten materials may be substantially flooded with an inert gas or a reductant gas to prevent oxidation of the molten materials. In some embodiments, pressure may be applied to the molten matrix material 52, hard particles 50, and nanoparticles 54 to facilitate the infiltration process and to substantially prevent the formation of voids within the bit body 12 being formed.

After the hard particles 50 and nanoparticles 54 have been infiltrated with the molten matrix material 52, the molten matrix material 52 may be allowed to cool and solidify, forming a solid matrix material 52 of the particle-matrix composite material 15.

In some embodiments, the bit body 12 may be formed using so-called particle compaction and sintering techniques such as, for example, those disclosed in application Ser. No. 11/271,153, filed Nov. 10, 2005, now U.S. Pat. No. 7,802,495, issued Sep. 28, 2010, and in application Ser. No. 11/272,439, filed Nov. 10, 2005, now U.S. Pat. No. 7,776,256, issued Aug. 17, 2010, each assigned to the Assignee of the present disclosure and the disclosure of which is incorporated herein in its entirety by reference. Briefly, a powder mixture may be pressed to form a green bit body or billet, which then may be sintered one or more times to form a bit body 12 having a desired final density.

The powder mixture may include a plurality of hard particles 50, a plurality of nanoparticles 54, and a plurality of particles comprising a matrix material 52, as previously described herein. Optionally, the powder mixture may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction. Furthermore, the powder mixture may be milled, which may result in the hard particles 50 being at least partially coated with the matrix material 52 and nanoparticles 54.

The powder mixture may be pressed (e.g., axially within a mold or die, or substantially isostatically within a mold or container) to form a green bit body. The green bit body may be machined or otherwise shaped to form features such as blades, fluid courses, internal longitudinal bores, cutting element pockets, etc., prior to sintering. In some embodiments, the green bit body (with or without machining) may be partially sintered to form a brown bit body, and the brown bit body may be machined or otherwise shaped to form one or more such features prior to sintering the brown bit body to a desired final density.

The sintering processes may include conventional sintering in a vacuum furnace, the sintering in a vacuum furnace followed by a conventional hot isostatic pressing process, and sintering immediately followed by isostatic pressing at temperatures near the sintering temperature (often referred to as "sinter-HIP"). Furthermore, the sintering processes may include subliquidus phase sintering. In other words, the sintering processes may be conducted at temperatures proximate to but below the liquidus line of the phase diagram for the matrix material. For example, the sintering processes described herein may be conducted using a number of different methods known to one of ordinary skill in the art, such as the Rapid Omnidirectional Compaction (ROC) process, the CERACON® process, hot isostatic pressing (HIP), or adaptations of such processes.

When the bit body 12 is formed by particle compaction and sintering techniques, the bit body 12 may not include a metal blank 16 and may be secured to the shank 20 by, for example, one or more of brazing, welding, and mechanical interlocking.

The particle-matrix composite material 15 (FIG. 1) of the present disclosure may also be used to form a hardfacing material (not shown) for use on an earth-boring tool. Hardfacing materials may be added on bit bodies and roller cones wherever increased wear resistance is desired. For example, in one embodiment, the particle-matrix composite material 15 may comprise a hardfacing material comprising a cemented carbide material. For example, the hard particles 50 may comprise tungsten carbide, and the matrix material 52 comprises cobalt having a plurality of nanoparticles 54 dispersed therein.

The particle-matrix composite material 15 (FIG. 1) may also be used to form other earth-boring and other down-hole tools and components including, but not limited to, impregnated bits, hot pressed or sintered diamond-enhanced carbide segments, bearings, inserts for roller cone bits, substrates for superabrasive cutting elements such as polycrystalline diamond cutting elements, and any other components that may be formed from a particle-matrix composite material, as known in the art. For example, the particle-matrix composite material 15 may be included in rubbing blocks and bearing blocks as described in detail in U.S. Pat. No. 7,814,997, entitled Interchangeable Bearing Blocks for Drill Bits, and Drill Bits Including Same, which issued Oct. 19, 2010 and U.S. patent application Ser. No. 12/766,988, entitled Bearing Blocks for Drill Bits, Drill Bit Assemblies Including Bearing Blocks and Related Methods, filed Apr. 26, 2010, pending, the entire disclosure of each of which is incorporated herein by this reference. In addition, the particle-matrix composite material 15 may be included in impregnated bits and segments for such impregnated bits as described in detail in U.S. Pat. No. 6,241,036, entitled Reinforced Abrasive-Impregnated Cutting Elements, Drill Bits Including Same, which issued Jun. 5, 2001, and U.S. Pat. No. 6,742,611 entitled Laminated and Composite Impregnated Cutting Structures for Drill Bits, which issued Jun. 1, 2004, the entire disclosure of each of which is incorporated herein by this reference.

Figure 4:
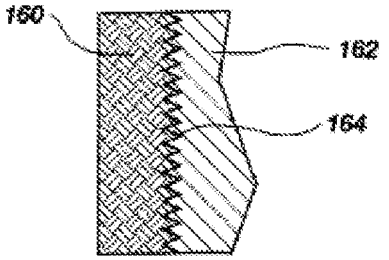
FIGS. 4 through 6 illustrate exemplary impregnated segments, and segment-retaining portions inherent in some embodiments of the present disclosure.
Figure 5:
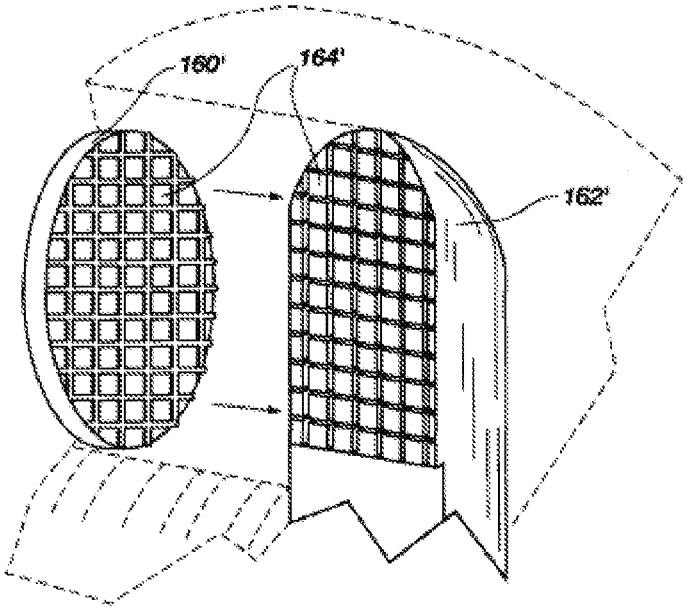
Figure 6:
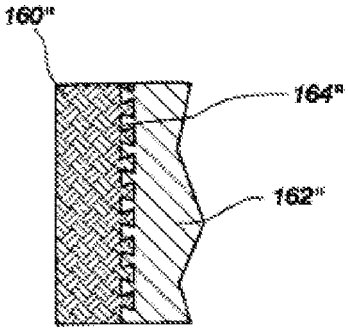

Referring to FIGS. 4-6, to enhance the strength with which an impregnated segment is bound to its corresponding securing member, the surface area of the interface 164, 164', 164" between an impregnated segment 160, 160', 160" and its corresponding support member 162, 162', 162", respectively, is preferably increased relative to that if a flat interface is employed. Accordingly, the segment-retaining portion of the support member 162, 162', 162" and the member-securing portion of the impregnated segment 160, 160', 160", respectively, may each comprise rough, preferably complementary, surfaces. Such high surface area interfaces prevent shearing or delamination of an impregnated segment off of a support member, which may be caused by bending stresses on the cutting element or to normal forces on the cutting element parallel to the member/segment interface. Accordingly, the mutually engaging surfaces of the impregnated segment-support member interface 164, 164', and 164" may include complementary thread cut (see FIG. 4), waffle (see FIG. 5), dove-tailed (see FIG. 6), dotted, or cross-hatched surfaces; apertures or blind holes and complementary protrusions; heavily sandblasted or otherwise roughened surfaces; or other configurations that increase the mutually-engaging surface areas of the two components. High surface area impregnated segment support member interfaces are particularly useful in embodiments of the present invention that include relatively large, thin impregnated segments.

Figure 3:
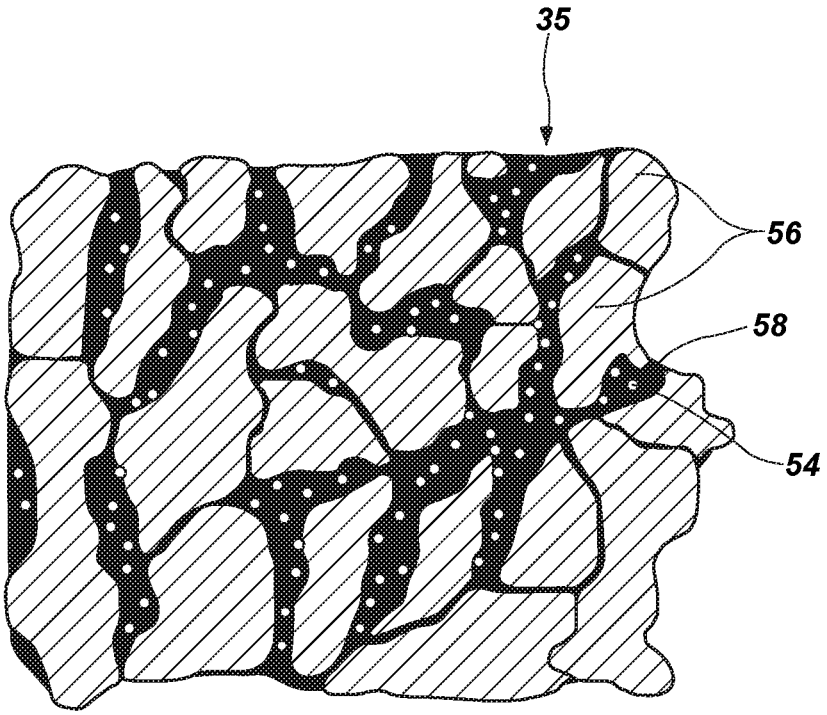
FIG. 3 is an illustration representing one example of how a microstructure of a diamond table of the present disclosure may appear under magnification.

In further embodiments, the nanoparticles 54 may also be used to form a polycrystalline diamond table 35 such as in the polycrystalline diamond compact (PDC) cutters 34 of the drill bit 10 of FIG. 2. FIG. 3 is an enlarged view illustrating how a microstructure of the diamond table 35 of the PDC cutters 34 may appear under magnification. As shown in FIG. 3, the diamond table 35 includes diamond crystals 56 that are bonded together by inter-granular diamond-to-diamond bonds. A catalyst material 58 used to catalyze the formation of the inter-granular diamond-to-diamond bonds is disposed in interstitial regions or spaces between the diamond crystals 56. The catalyst material 58 includes a plurality of nanoparticles 54, as previously described herein, and dispersed therethrough. The nanoparticles 54 may comprise, for example, less than about ten percent (10%) by volume of the catalyst material 58. The catalyst material 58 may comprise any material that is capable of substantially catalyzing the formation of inter-granular bonds between grains of hard material during a high-temperature/high-pressure (HTHP) process, as known to those of ordinary skill in the art. For example, catalyst materials for diamond include cobalt, iron, nickel, other elements from Group VIIIA of the periodic table of the elements, and alloys thereof. The material of the nanoparticles 54 may be selected to improve a desired characteristic of the catalyst material 58. In one embodiment, the nanoparticles may comprise diamond coated with a catalyst material. For example, the nanoparticles 54 may help to improve formation of the inter-granular bonds between the diamond crystals 56, as the nanoparticles 54 may help strengthen the catalyst material 58, or the nanoparticles 54 may help to prevent degradation of the inter-granular bonds during drilling operations. In addition, because of the increased surface area of the nanoparticles 54, a lower concentration of the catalyst material 58 may be used to form the diamond table 35. Additionally, the nanoparticles 54 may also make it easier to leach the catalyst material 58 out of the diamond table 35, if desired.

By incorporating nanoparticles into the particle-matrix phase of composite materials, the composite materials may be tailored to exhibit a desired characteristic. For example, the composite material may exhibit an improved hardness, wear resistance, erosion resistance, fracture resistance, strength, yield point, ductility, impact strength, abrasivity, improved magnetic susceptibility, amongst other desirable improvements. While not wishing to be bound by any particular theory, it is believed that the presence of the nanoparticles may serve to tie up grain boundaries and dislocations in the composite material.

While the present disclosure is described herein in relation to embodiments of concentric earth-boring rotary drill bits that include fixed-cutters and to embodiments of methods for forming such drill bits and cutters, the present disclosure also encompasses other types of earth-boring tools such as, for example, core bits, eccentric bits, bicenter bits, reamers, mills, roller cone bits and hybrid bits employing both fixed and movable cutting structures, as well as methods for forming such tools. Thus, as employed herein, the term "bit body" includes and encompasses bodies of all of the foregoing structures, as well as components and subcomponents of such structures.

While the present disclosure has been described herein with respect to certain embodiments, those of ordinary skill in the art will recognize and appreciate that it is not so limited. Rather, many additions, deletions and modifications to the embodiments described and illustrated herein may be made without departing from the scope of the invention as hereinafter claimed, including legal equivalents. In addition, features from one embodiment may be combined with features of another embodiment while still being encompassed within the scope of the invention as contemplated by the inventors. Further, the invention has utility in drill bits and core bits having various different bit profiles, as well as various different cutter types.

What is claimed is:

1. A polycrystalline compact cutting element for use in an earth-boring tool, the cutting element comprising a region of polycrystalline material comprising nanoparticles in interstitial spaces between inter-bonded crystals in the region of polycrystalline material, wherein the nanoparticles comprise a catalyst material, and a material selected from the group consisting of borides, nitrides, oxides, carbides, and diamond.

2. A method of forming an earth-boring tool, the method comprising:

providing hard particles and carbon nanotubes within a cavity of a mold, the cavity having a shape corresponding to at least a portion of a bit body of an earth-boring tool for drilling subterranean formations, wherein the hard particles exhibit an average diameter in a range extending from about 0.5 microns to about 20.0 microns and comprise at least one material selected from the group consisting of diamond, tungsten boride, titanium boride, molybdenum boride, niobium boride, vanadium boride, hafnium boride, zirconium boride, silicon boride, tantalum boride, and chromium boride, wherein the carbon nanotubes exhibit an average diameter of about 500 nm or less;

infiltrating the hard particles and the carbon nanotubes with a molten matrix material comprising a metal alloy comprising indium;

cooling the molten matrix material to form a solid matrix material surrounding the hard particles wherein the carbon nanotubes comprise between about 1% and about 25% of the solid matrix material by weight and the carbon nanotubes improve formation and help prevent degradation of intergranular bonds in the solid matrix material; and disposing at least one cutter on the bit body.

3. A method of forming a component of an earth-boring tool, the method comprising:

mixing hard particles, carbon nanotubes exhibiting an average diameter of about 500 nm or less, and particles comprising a metal matrix material to form a powder mixture, wherein the carbon nanotubes comprise between about 1% and about 25% of the powder mixture by weight; wherein the metal matrix material comprises indium, and wherein the hard particles exhibit an average diameter in a range extending from about 0.5 microns to about 20.0 microns and comprise at least one material selected from the group consisting of diamond, tungsten boride, titanium boride, molybdenum boride, niobium boride, vanadium boride, hafnium boride, zirconium boride, silicon boride, tantalum boride, and chromium boride;

pressing the powder mixture to form a green body; and sintering the green body to a desired final density such that the carbon nanotubes improve formation and help prevent degradation of intergranular bonds in the component.

4. A method of forming a polycrystalline compact cutting element for an earth-boring tool, the method comprising:

sintering a mass of hard particles interspersed with a mixture comprising carbon nanotubes and a catalyst material under high pressure, high temperature conditions, wherein the carbon nanotubes comprise between about 1% and about 25% of the mixture by weight and exhibit an average diameter of about 500 nm or less, wherein the hard particles exhibit an average diameter in a range extending from about 0.5 microns to about 20.0 microns and comprise at least one material selected from the group consisting of diamond, tungsten boride, titanium boride, molybdenum boride, niobium boride, vanadium boride, hafnium boride, zirconium boride, silicon boride, tantalum boride, and chromium boride, wherein the catalyst material comprises a metal alloy comprising indium; and causing the carbon nanotubes to improve formation and help prevent degradation of intergranular bonds in the mass.

5. The method of claim 4, wherein sintering a mass of hard particles comprises sintering a mass of diamond particles.

6. The polycrystalline compact cutting element of claim 1, wherein the polycrystalline material comprises a material selected from the group consisting of diamond, boron carbide, boron nitride, silicon nitride, aluminum nitride, and carbides or borides of the group consisting of W, Ti, Mo, Nb, V, Hf, Zr, Si, Ta, and Cr.

7. The polycrystalline compact cutting element of claim 6, wherein the polycrystalline material comprises diamond.

8. The polycrystalline compact cutting element of claim 1, wherein the inter-bonded crystals and nanoparticles comprise different materials from one another.

9. The polycrystalline compact cutting element of claim 1, wherein the nanoparticles comprise a material selected from the group consisting of carbon nanotubes, fullerenes, adamantanes, and amorphous carbon.

10. The polycrystalline compact cutting element of claim 1, wherein the nanoparticles comprise particles having an average aspect ratio of one hundred to one (100:1) or less.

11. The polycrystalline compact cutting element of claim 1, wherein the nanoparticles further comprise a material selected from the group consisting of vanadium carbide and titanium diboride.

12. The polycrystalline compact cutting element of claim 1, wherein the nanoparticles comprise a coating of the catalyst material.

13. The polycrystalline compact cutting element of claim 1, wherein the nanoparticles further comprise a coating material selected from the group consisting of tin oxide, tungsten, nickel, and titanium.

14. The polycrystalline compact cutting element of claim 1, wherein the polycrystalline material further comprises a material selected from the group consisting of silver, gold, and indium within the interstitial spaces.

15. The polycrystalline compact cutting element of claim 1, wherein the catalyst material comprises a material selected from the group consisting of cobalt, iron, and nickel.

16. The polycrystalline compact cutting element of claim 1, wherein the nanoparticles further comprise diamond.

17. The polycrystalline compact cutting element of claim 16, wherein the diamond is coated with the catalyst material.

18. The polycrystalline compact cutting element of claim 1, wherein the polycrystalline material further comprises a matrix material within the interstitial spaces, the matrix material comprising the nanoparticles dispersed therein.

19. The polycrystalline compact cutting element of claim 18, wherein the nanoparticles have a higher hardness than the matrix material.

* * * * *